US010065839B2

(12) United States Patent
Park

(10) Patent No.: US 10,065,839 B2
(45) Date of Patent: Sep. 4, 2018

(54) BRAKE SYSTEM FOR PASSENGER CONVEYORS

(75) Inventor: Chan-Jong Park, Vienna (AT)

(73) Assignee: OTIS ELEVATOR COMPANY, Farmington, CT (US)

( * ) Notice: Subject to any disclaimer, the term of this patent is extended or adjusted under 35 U.S.C. 154(b) by 0 days.

(21) Appl. No.: 14/370,718

(22) PCT Filed: Jan. 6, 2012

(86) PCT No.: PCT/US2012/020451
§ 371 (c)(1),
(2), (4) Date: Nov. 19, 2014

(87) PCT Pub. No.: WO2013/103352
PCT Pub. Date: Jul. 11, 2013

(65) Prior Publication Data

US 2015/0090558 A1 Apr. 2, 2015

(51) Int. Cl.
*B66B 23/20* (2006.01)
*B66B 23/16* (2006.01)
(Continued)

(52) U.S. Cl.
CPC ..... *B66B 23/20* (2013.01); *B66B 21/02* (2013.01); *B66B 23/026* (2013.01); *B66B 23/04* (2013.01);
(Continued)

(58) Field of Classification Search
CPC ..... B66B 23/20; B66B 23/24; B66B 23/06; B66B 21/02; B66B 23/04; B66B 23/16
See application file for complete search history.

(56) References Cited

U.S. PATENT DOCUMENTS 3,749,224 A * 7/1973 Engeler ..... B66B 23/04 198/331
5,072,820 A 12/1991 Steffen et al.
(Continued)

FOREIGN PATENT DOCUMENTS

CN 201292192 Y 8/2009
CN 101628683 A 1/2010
(Continued)

OTHER PUBLICATIONS

Chinese Office Action for application CN 201280066311.7, dated May 26, 2015, 4 pages.
(Continued)

*Primary Examiner* — Thomas Randazzo
(74) *Attorney, Agent, or Firm* — Cantor Colburn LLP

(57) ABSTRACT

A system for braking an escalator or moving walkway includes a handrail and passenger support in registration with one another so as to move together. A braking tensioner selectively increases tension in the handrail during operation. The increased tension serves to frictionally brake the handrail and hence the passenger support. The braking tensioner may be located in any of various locations depending upon system design, and may be driven in any suitable manner, e.g., hydraulically, electrically, electromagnetically, and so on. Frictional wear on the handrail is reduced by the fact that the described braking system spreads the frictional load over a large area of the handrail, e.g., the many locations where the handrail contacts the underlying support throughout its length.

26 Claims, 6 Drawing Sheets

(51) Int. Cl.

| | |
|---|---|
| ***B66B 23/04*** | (2006.01) |
| ***B66B 21/02*** | (2006.01) |
| ***B66B 23/06*** | (2006.01) |
| ***B66B 23/24*** | (2006.01) |
| ***B66B 23/02*** | (2006.01) |

(52) U.S. Cl.
CPC ..... *B66B 23/06* (2013.01); *B66B 23/16* (2013.01); *B66B 23/24* (2013.01)

(56) References Cited

U.S. PATENT DOCUMENTS 5,188,209 A * 2/1993 Johnson ..... B66B 23/20 198/336
5,207,308 A * 5/1993 Sheffield ..... B66B 23/20 198/336
5,295,567 A * 3/1994 Zaharia ..... B66B 29/04 198/323
5,544,730 A * 8/1996 Adrian ..... B66B 23/20 198/336
5,566,810 A * 10/1996 Meyer ..... B66B 23/04 198/331
6,460,679 B1 * 10/2002 Stuffel ..... B66B 23/20 198/336
6,974,018 B2 * 12/2005 Lunardi ..... B66B 23/04 198/330
7,954,620 B2 * 6/2011 Winkelhake ..... A61K 31/4985 198/330

FOREIGN PATENT DOCUMENTS

CN 201390585 Y 1/2010
JP H07137975 A 5/1995
JP 2005187177 A * 7/2005 ..... B66B 23/20
JP 2005187177 A 7/2005

OTHER PUBLICATIONS

International Search Report and Written Opinion for PCT/US2012/020451, dated Aug. 24, 2012, 8 pages.
Japanese Office Action for application JP 2014-551227, dated Jul. 22, 2015, 3 pages.

* cited by examiner

BRAKE SYSTEM FOR PASSENGER CONVEYORS

TECHNICAL FIELD

This patent disclosure relates generally to passenger conveyors and, more particularly to a braking system for passenger conveyors.

BACKGROUND

As our world becomes faster and more automated, the need for all manner of passenger conveyors continues to increase, as does the load on existing conveyance devices. Within the built environment, several types of conveyors, namely elevators, escalators and moving walkways made larger and more efficient buildings possible throughout the last century.

Nonetheless, as the demand for passenger conveyance continues to increase and the existing infrastructure in place continues to age, the requirement to periodically halt and repair or modify escalators and walkways in particular has become significant. Moreover, whatever the state of repair may be, an escalator may occasionally need to be stopped for emergency reasons, such as when a passenger is experiencing trouble with the system.

When an escalator is stopped, two things must occur. First, the motor powering the escalator, typically a powerful electrical motor, is deactivated. Secondly, at essentially the same time a brake is applied to prevent movement of the escalator until it is reactivated for use. Because of the importance of proper braking, it is typical to equip passenger conveyor systems with two braking systems, namely, an operational brake and an auxiliary brake. The operational brake is typically located in the drive system and is used for routine stopping and holding of escalators. The auxiliary brake, in contrast, is an additional safety brake, usually found in the main drive assembly in the upper landing area, and is activated in accordance with local safety codes when conditions warrant. Each of these braking systems requires space for installation and operation, and also requires periodic inspection, repair, and maintenance.

Thus, while braking of the passenger conveyor is important, the way in which braking is accomplished in modern passenger conveyors may be improved to reduce the space requirements and financial cost imposed by braking systems as well as to improve reliability. To this end, the inventor describes a new braking system for passenger conveyors as discussed below.

It will be appreciated that this background description has been created by the inventor to aid the reader, and is not to be taken as a reference to prior art, nor as an indication that any of the indicated problems were themselves appreciated in the art.

SUMMARY

In overview, the described system provides in one embodiment a passenger conveyor having an improved braking system. The passenger conveyor includes a passenger support configured to support one or more passengers and a continuous handrail linked to the passenger support so that the two portions move in registration with one another. The handrail may be guided on its path by a handrail guide. A drive system is provided for driving the passenger support and handrail while conveying one or more persons standing on the passenger support. A brake system selectively prevents movement of the handrail and thus the passenger support portion via a tensioner for selectively increasing a tension in the continuous handrail such that friction between the handrail and the underlying support is increased and the handrail is precluded from moving, thereby stopping the movement of the passenger support.

The passenger conveyor may be any one of a number of device types, including escalators and moving sidewalks. Similarly, the passenger support may employ a linked plurality of treadplates, such as steps or pallets, or a conveyor belt.

In an embodiment of the invention, the tensioner includes a tension bow adjacent the handrail and a forcing member associated with the tension bow for forcing the tension bow against the handrail. The tension bow may be a roller bow, a sliding bow, or other mechanism for engaging the handrail.

The handrail may traverse first and second turnaround portions where the continuous handrail turns substantially one hundred and eighty degrees, transition curve portions, as well as one or more linear portions wherein the continuous handrail moves in a linear fashion. The tensioner may be located at any one of these locations, or may be located adjacent a handrail drive pulley or at any other convenient location along the path of the handrail. The forcing member associated with the tension bow may be hydraulically actuated, electrically actuated, electro-magnetically actuated, or spring actuated.

In another embodiment of the invention, a method is provided for braking a passenger conveyor having a passenger support and a handrail linked to the passenger support such that the passenger support and the continuous handrail move in registration with one another. The method includes detecting a need to brake the passenger conveyor and selectively increasing a tension of the handrail to increase the friction between the handrail and underlying support until the handrail is precluded from moving, thus also stopping the passenger support portion.

The passenger conveyor in accordance with this embodiment of the invention may be an escalator or a moving sidewalk, for example, and the passenger support may include one of a conveyor belt and a linked plurality of treadplates, such as steps or pallets.

In an aspect of this embodiment of the invention, the passenger conveyor includes a tension bow adjacent the handrail and a forcing member associated with the tension bow. In this case, selectively increasing a tension of the handrail is executed by forcing the tension bow against the handrail via the forcing member.

As with other embodiments of the invention, the tension bow may be, for example, a roller bow or a sliding bow. The tension bow may be forced against the handrail at any suitable location including at a turnaround portion where the handrail turns one hundred and eighty degrees, transition curve portions, adjacent a handrail driving pulley, or in a linear portion or at any other convenient location along the path of the handrail.

As with other embodiments, the forcing of the tension bow against the handrail may be carried out by any one or more of a hydraulic mechanism, an electro-magnetic mechanism, an electrical mechanism, and a spring mechanism.

In a further embodiment of the invention, a brake system for application to a passenger conveyor is provided. In this embodiment, a tension element configured to engage the passenger handrail of the passenger conveyor is provided to selectively increase tension therein. A forcing member is linked to the tension element and configured to selectively force the tension element against the passenger handrail for slipping engagement when actuated to provide a braking force resulting from increased tension of the handrail.

As in other embodiments, the tension element may for example be one of a roller bow and a sliding bow, and the forcing member may be actuated via one of hydraulic, electro-magnetic, electrical, and spring force.

It will be appreciated that different embodiments of the invention are not mutually exclusive, and that elements from any embodiment may be combined with one or more elements from any other embodiment, and that the division of the discussion into embodiments is made in order to break the disclosure down for reader convenience and not to signify different mutually exclusive inventions. Further and alternative aspects and features of the disclosed principles will be appreciated from the following detailed description and the accompanying drawings, of which:

DETAILED DESCRIPTION

This disclosure relates to passenger conveyors having a moving step or standing portion, such as steps or floor segments, linked to one or more coordinated moving handrails for passenger support. The handrails are typically located on either side of the conveyor, within arm's reach of passengers on the conveyor. Typical embodiments include escalators and incline moving walkways for both vertical and horizontal movement of passengers as well as horizontal moving walkways for horizontal movement of passengers. The former may be used to move passengers between a limited number of contiguous floors in a building, while the latter may be used to quickly move passengers throughout a large flat space such as between airport terminals in an airport.

In overview, the described system provides an improved braking system that serves the role of either the operational brake system or the auxiliary brake system or both. The described braking system can be installed as a part of a new installation or may be provided as a retrofit to an existing installation. In either case, the handrail friction, which is typically minimized, is selectively employed to provide a strong braking force. Due to the mechanical link between the handrail and the conveyor, the stopping of the handrail also serves to reliably stop the conveyor itself.

Figure 1:
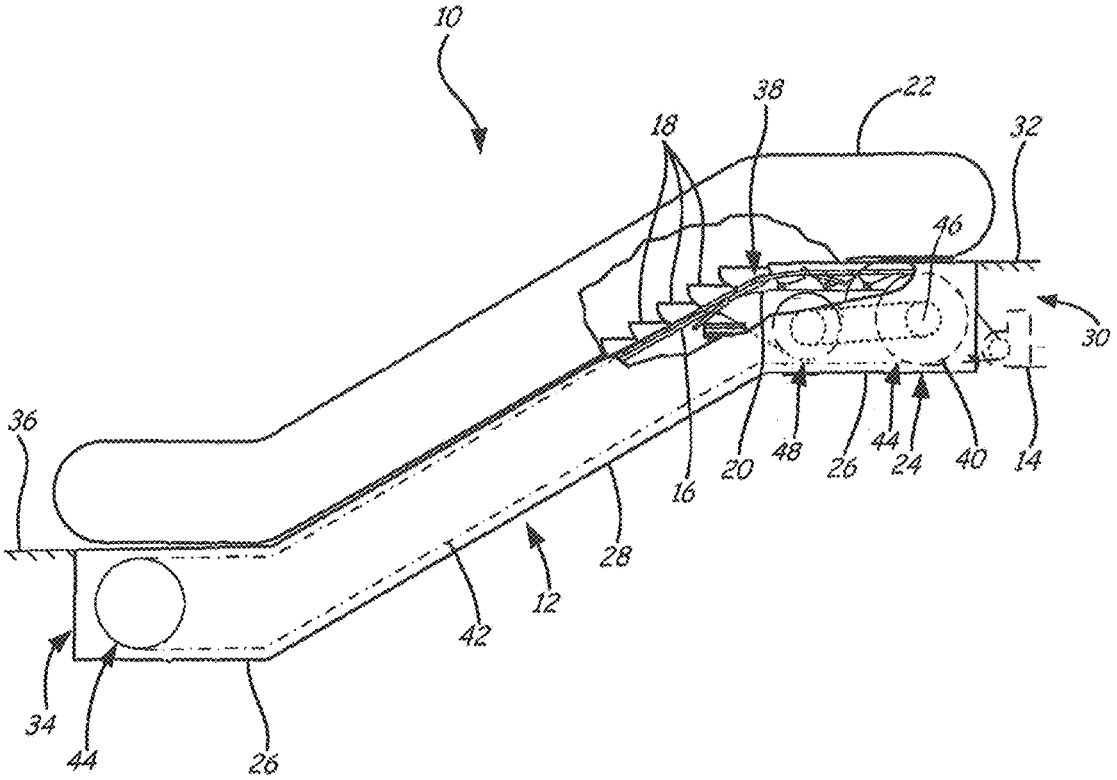
FIG. 1 is a schematic elevation view of an escalator within which embodiments of the disclosed principles may be implemented.

Turning now to the details of certain exemplary embodiments, FIG. 1 is a schematic elevation view of an escalator as summarized in the brief description of drawings above. The illustrated escalator 10 includes a frame 12, drive system 14, step chain 16, steps 18, roller tracks 20, and balustrade assemblies 22. The frame 12 includes truss section 24 on both the left and right hand sides of frame 12, although only one side is visible in the figure. Each truss section 24 has two end sections 26 parallel to one another, connected by an inclined midsection 28. The end sections 26 form upper landing 30 at upper elevation 32 and lower landing 34 at lower elevation 36. Matching pairs of roller tracks 20 are attached on the inside of each truss section 24, i.e. the side of truss section 24 facing the other truss section 24. The region between inclined midsection 28 and landings 30, 34 in which the slope of roller track 20 is changing from the slope of incline 28 to the slope of landings 30, 34, is defined to be transition region 38.

The upper landing 30 houses the escalator drive 14, between truss sections 24. The drive 14 powers a pair of step chain sprockets 40, which in turn impart linear motion to step chains 16. Steps 18 are connected to step chains 16 and guided along roller tracks 20 as they are driven along with step chains 16 by escalator drive 14. Step chains 16 and steps 18 travel through closed loop path 42 (shown in phantom in FIG. 1), running from one elevation to the other elevation (32, 36), and back. The regions of the closed loop path through which step chains 16 and steps 18 travel include two turnarounds 44 as chain 16 and steps 18 travel around two sprockets 40 or one sprocket and one turnaround track at upper and lower landings 30, 34.

As noted above, the drive 14 powers step chain sprocket 40 being associated with the upper landing 30. In an embodiment, the step chain sprocket 40 associated with the upper landing 30 has affixed thereto a handrail drive sprocket 46 for driving a handrail movement system 48, which will be described in greater detail below. In an embodiment, the handrail drive sprocket 46 is a double sprocket configured to drive the handrail movement system 48 via two chains in parallel.

Figure 2:
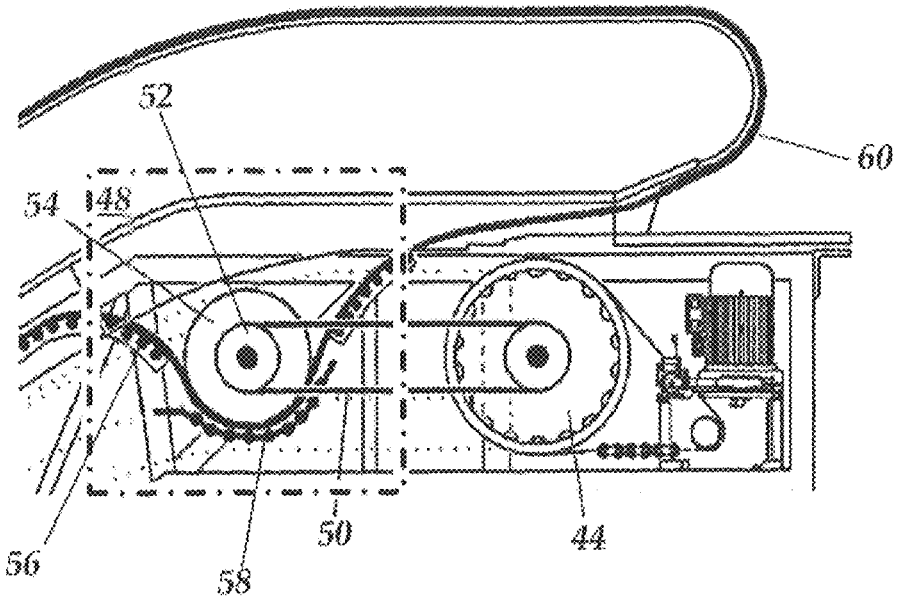
FIG. 2 is a detailed schematic elevation view of a handrail movement system with respect to which embodiments of the disclosed principles may be implemented.

Turning to FIG. 2, a schematic elevation view of the handrail movement system 48 and related components and systems is shown in greater detail. As noted, the handrail movement system 48 is driven from a paired sprocket on the main drive assembly step chain sprocket 40 via handrail drive chain 50, which may be a single multiplex chain or multiple chain strands in order to transfer sufficient force to both drive the handrail and brake the main drive assembly. Within the handrail movement system 48, the handrail drive chain 50 is linked via a driven sprocket 52 to a handrail drive pulley 54 affixed to the driven sprocket 52.

The handrail drive pulley 54 is positioned and configured to drive the handrail of the escalator in driving condition. However, it is driven by the handrail in the braking condition. In particular, a pair of outer roller guides 56 in cooperation with a wrapping roller guide 58 serve to partially wrap the handrail 60 on the handrail drive pulley 54. In this way, when the handrail drive pulley 54 rotates, the handrail 60 is pulled forward or backward. Because the handrail 60 forms a continuous loop around the escalator side structure, the entire handrail 60 moves. The gearing relationships of the rotating parts and the size of the handrail drive pulley 54 are used to establish the speed at which the handrail 60 moves relative to rotation of the drive system 14. In this way, the movement of the handrail 60 is registered with the movement of the steps 18, for both driving and braking the two components synchronously.

Figure 3:
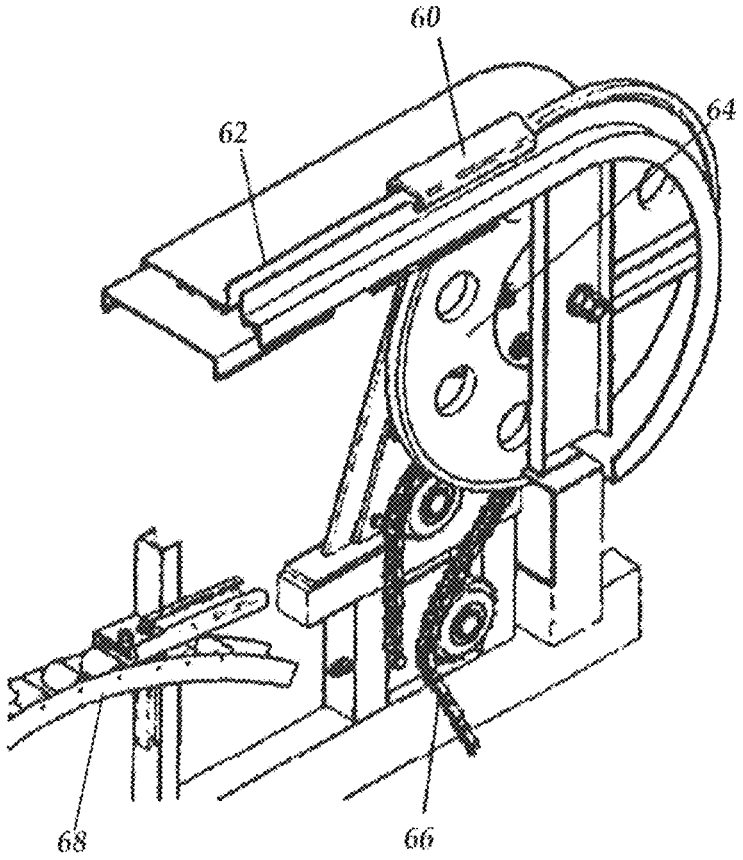
FIG. 3 is a perspective cut away view of a handrail drive mechanism for use in installations having an opaque balustrade.

While the arrangement of FIG. 2 for moving the handrail 60 serves to hide the handrail driving mechanism in installations having a glass balustrade, other arrangements may be used as well. FIG. 3 is a perspective cut away view of a handrail drive mechanism for use in installations having an opaque balustrade. Most of the handrail 60 has been omitted for clarity in this view.

As can be seen, the handrail 60 rides on and is retained by an underlying structure or underlying support such as handrail guide 62. The handrail 60 is propelled by drive pulley 64 positioned in the illustrated embodiment as a turnaround at the upper landing. The drive pulley 64 is driven by chain drive 66 registered with a step drive system (not shown in this figure) similar to the drive arrangement shown in FIG. 1. It will be appreciated that a roller guide system 68 is beneficial in this arrangement as well in order to ensure continued registration of the handrail 60 with the drive pulley 64 and the handrail guide 62.

The handrail drive pulley 64 is positioned and configured to drive the handrail of the escalator in driving condition and transfer braking forces from the handrail in the braking condition. With respect to the driving condition, the handrail 60 will have been initially adjusted during installation or repair to transfer enough driving force by frictional coupling between handrail 60 and handrail drive pulley 64. Similarly, braking force is transferred from the handrail 60 to the handrail drive pulley 64 via frictional engagement between handrail 60 and handrail drive pulley 64. In this way, when the handrail drive pulley 64 rotates, the handrail 60 is pulled forward or backward. Because the handrail 60 forms a continuous loop around the escalator side structure, the entire handrail 60 moves.

The gearing relationships of the rotating parts and the size of the handrail drive pulley 64 are used to establish the speed at which the handrail 60 moves relative to rotation of the drive system 14. In this way, the movement of the handrail 60 is registered with the movement of the steps 18, for both driving and braking the two components synchronously.

In the illustrated arrangements as well as other drive arrangements, the handrail experiences frictional resistance with the underlying guide structure. This frictional resistance can cause substantial loss of efficiency of the entire escalator if the tension of the handrail is not properly set. At the same time, if the handrail tension is set too low, the handrail may lose lateral registration with the underlying guide structures and/or may lose registration with the steps by slipping, e.g., on the drive pulley.

Although handrail friction has always been viewed as a problem requiring minimization, the inventor has found that he can manipulate the handrail tension to provide a beneficial braking action. In particular, handrail friction is a function of normal force between the handrail and an underlying guide surface, and that the normal force is a function of the tension in the handrail. Therefore, increased handrail tension results in increased friction forces that can be used to brake the handrail, and with it, the passenger-bearing elements as well. Thus, while the handrail tension should still be set to maximize efficiency, i.e., to reduce running friction to the lowest possible level, a separate additional mechanism is included in an embodiment for selectively increasing the tension of the handrail and thus increasing the frictional resistance experienced by the handrail.

Although the initial tension of the handrail may indeed be increased to a level sufficient to prevent movement of the escalator, the regular operation of the escalator requires that the handrail and steps be free to move. Thus, the initial tension of the handrail must be set to a conventional lower level that allows such movement, and a system is provided in an embodiment for selectively increasing the handrail tension only when braking is desired.

Figure 4:
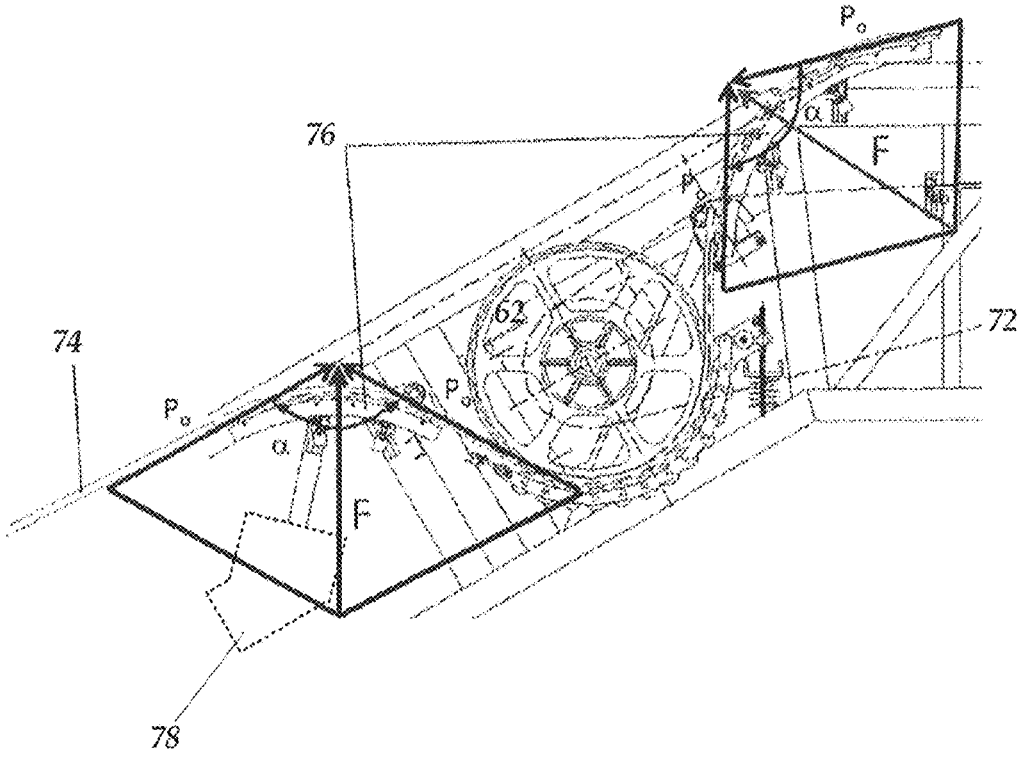
FIG. 4 is a schematic detail view of a handrail drive portion of an escalator as used in a glass balustrade installation.
Figure 5:
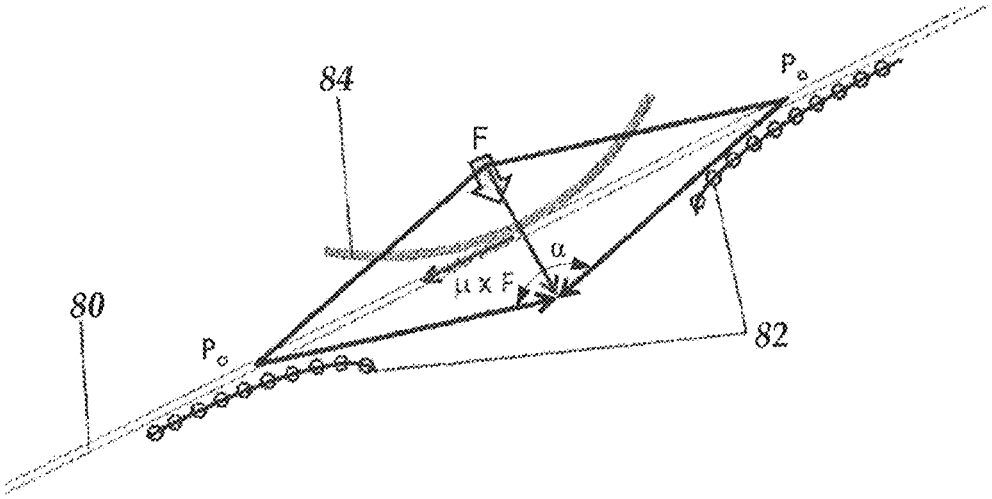
FIG. 5 is a schematic view of a lower linear handrail portion having a braking tension system.

FIGS. 4 and 5 illustrate two configurations by which the handrail tension may be selectively increased to facilitate operational and/or auxiliary braking of the escalator. Referring to FIG. 4 specifically, this figure shows a schematic detail view of the handrail drive portion of an escalator as used in a glass balustrade installation. The illustrated portion includes a handrail drive pulley 62 driving handrail 74. The handrail 74 is guided by roller bow assemblies 76. In the illustrated embodiment, at least one of the roller bow assemblies 76 (tension element) is linearly actuated via a driver 78 (forcing element) toward or away from the handrail drive pulley 62 so as to increase or decrease the tension of the handrail 74.

The driver 78 may be mechanical, hydraulic or magnetic, and/or may include a spring for actuation. Examples of mechanical drives include screw drives, rack and pinion drives, and so on, while examples of hydraulic drives include hydraulic rams and scissor drives among others. A magnetic drive may use magnetic force either to hold the roller bow 76 in the non-braking position until actuated, or may use magnetic force to drive the roller bow 76 toward the handrail drive pulley 72 at the time of actuation. In any event, the braking system may be triggered automatically or manually. Similarly, after actuation, the roller bow 76 may be returned to the non-braking position manually or automatically. In the illustrated embodiment, the necessary force to apply to the roller bow will be dependent on the specific design of the passenger conveyor, handrail length, type of friction surfaces, incline angle, materials used, etc.

In another embodiment, the tension system for braking is located in the linear portion of the handrail run. This situation is illustrated in FIG. 5, which is a schematic view of a lower linear handrail portion having a braking tension system. In the illustrated embodiment, the handrail 80 in normal operation is surrounded by a plurality of roller guides 82 beneath it and a tension bow 84 above it. The tension bow may be of a roller or sliding type, with the required braking tension to be adjusted accordingly as described above.

During braking operation, the tension bow 84 pushes downward on the handrail 80, which is constrained from beneath by the plurality of roller guides 82. In this way, the tension $P_0$ of the handrail may be increased to the required braking level. As with the prior embodiment, the tension bow 84 may be actuated in any number of ways, including mechanical, hydraulic, magnetic, spring, etc. (not shown). The force with which the tension bow 84 must be actuated depends upon the angle of the handrail under the tension bow 84 during actuation.

The tension bow 84 acting on the handrail 80 displaces the handrail 80 and forces a bend of angle $\alpha$ into the handrail 80. In general, the larger the angle $\alpha$, up to 180° (i.e., the flatter the handrail in the region of displacement), the lower the applied force (F) requirement. Although the handrail 80 under the tension bow 84 is initially at 180°, it will deflect slightly to a final angle $\alpha$ that determines a fractional multiplier for the applied force required. Exemplary values for the multiplier are as follows:

| $\alpha$ (deg) | F(N) |
|---|---|
| 80 | 153.2% × $P_0$ |
| 90 | 141.4% × $P_0$ |
| 100 | 128.6% × $P_0$ |

-continued

| α (deg) | F(N) |
|---|---|
| 110 | 114.7% × $P_0$ |
| 120 | 100.0% × $P_0$ |
| 130 | 84.5% × $P_0$ |
| 140 | 68.4% × $P_0$ |
| 150 | 51.8% × $P_0$ |
| 160 | 34.7% × $P_0$ |
| 170 | 17.4% × $P_0$ |

Thus, for example, a curvature of 150° serves to reduce the applied force by about 50% of the required initial handrail tension force ($P_0$) to stop the passenger conveyor, while a curvature of 170° reduces the applied force by more than 80%. This leverage effect is due to the fact that a force applied along the base of a right triangle toward the hypotenuse results in a geometrically amplified resultant force along the hypotenuse, with the lowest amplification being essentially one (when the hypotenuse and base leg are essentially equal) and the highest amplification approaching infinity as the base leg (displacement) approaches zero. Quantitatively, given the geometric arrangement shown in FIG. 5, the amplification factor is $(\sin(90°-\alpha/2))^{-1}$.

Figure 6:
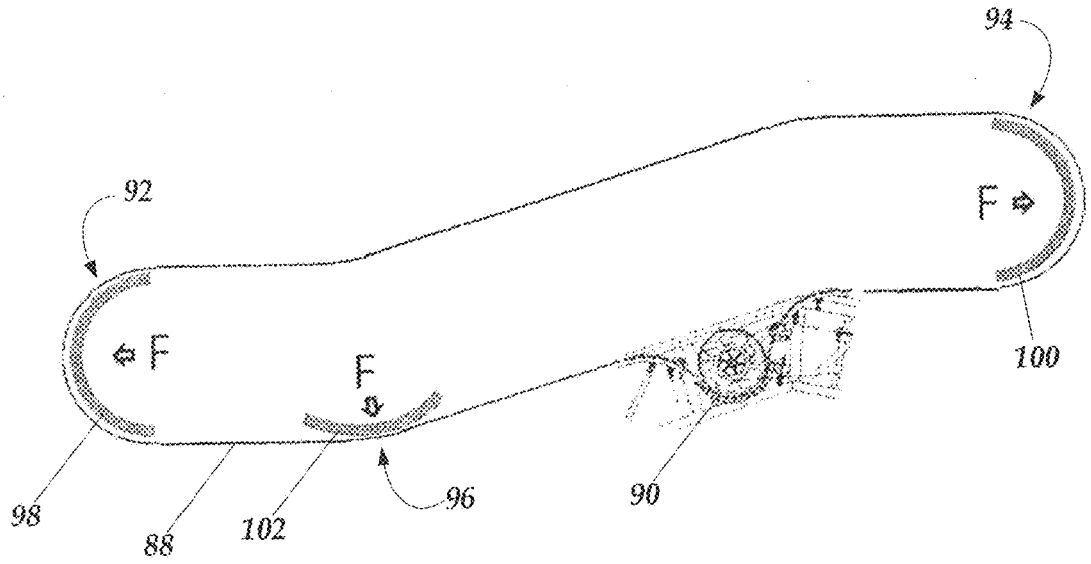
FIG. 6 is a simplified schematic view of a handrail and associated drive system showing certain alternative friction zones wherein tensioning may be implemented to provide braking in keeping with the described principles.

Because of the shallow bend in the handrail 80 allowed in the embodiment of FIG. 5, this embodiment is capable of providing a leverage advantage over the arrangement shown in FIG. 4. However, there are yet other ways in which the required braking force may be applied in keeping with the described principles. FIG. 6 shows a number of alternative arrangements, but should not be taken as an exhaustive illustration of all remaining brake tension application configurations.

In particular, FIG. 6 is a simplified schematic view of a handrail 88 and associated drive system 90, also showing certain alternative friction zones wherein tensioning may be implemented to provide braking in keeping with the described principles. The illustrated tension zones include a lower turn-around zone 92 and an upper turn-around zone 94. In addition, the illustrated schematic also shows transition zone 96.

The handrail tensioners in the various zones 92, 94, 96 may be implemented in any suitable fashion to increase handrail tension to a point where braking results. In an embodiment, handrail tensioners at the turn-around zones 92, 94 are implemented via roller or sliding turn-around bows 98, 100 located at the escalator ends. The handrail tensioner 102 located in the transition zone 96 is also illustrated as a roller or sliding bow. Although multiple handrail tensioner devices 98, 100, 102 are shown, it will be appreciated that a single tensioner may be used to increase the tension of the entire handrail, or a combination of tensioners may be used to provide both an operational brake and a redundant auxiliary brake.

As with the previously described embodiments, the handrail tensioners 98, 100, 102 may be tensioned via any suitable forcing mechanism. In various embodiments, the forcing mechanism includes one or more of a hydraulic piston or scissor, an electrical actuator such as a worm drive or other drive, an electro-magnetic drive, or a spring drive.

The described system has the additional benefit of spreading the frictional wear on the handrail over a large percentage of the area of the handrail instead of concentrating wear on a small area or element. In particular, although the increased handrail tension may be caused by a tensioner in a single area, the friction that results from the increase in tension occurs essentially every place the handrail contacts the underlying support throughout its length.

It will be appreciated that tensioner types and forcing systems other than those expressly mentioned herein may be used in keeping with the described principles. In addition, while the illustrated examples describe primarily escalator systems, it will be appreciated that the described principles apply equally to moving walkways and other passenger conveyor systems having a moving step or standing portion linked to a coordinated moving handrail portion.

Moreover, although the illustrations herein generally show a single handrail and certain aspects and features of the handrail, it will be appreciated that a passenger conveyor such as an escalator or moving sidewalk will typically have two such handrails, both of which are linked to the moving step portion of the device. Thus, it will be appreciated that the described tensioning systems may be implemented on a single one of, or both, such handrails. Further, it is contemplated that while tensioning systems implemented on both handrails will typically match, such is not required, and different tensioning systems may be used on different handrails of the same passenger conveyor without departing from the scope of the described principles.

Further, although illustrated as being implemented in either a pulley drive system as shown in FIG. 2 or a turnaround drive in FIG. 3, it will be appreciated that the described principles apply equally to other types of handrail drives systems, such as linear handrail drive systems.

Thus, it will be appreciated that the foregoing description provides useful examples of the disclosed system and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for the features of interest, but not to exclude such from the scope of the disclosure entirely unless otherwise specifically indicated.

I claim:

1. A passenger conveyor comprising:

a passenger support configured to support one or more passengers;

a handrail linked to the passenger support such that the passenger support and the handrail move in registration with one another, the handrail movement guided by an underlying support; and a brake system for selectively preventing movement of the handrail and the passenger support in registration with the handrail, the brake system including a tensioner for selectively increasing a tension of the handrail, whereby friction between the handrail and the underlying support precludes the handrail and passenger support from moving.

2. The passenger conveyor according to claim 1, wherein the brake system provides one or both of operational braking and auxiliary braking.

3. The passenger conveyor according to claim 1, wherein the passenger conveyor is one of an escalator and a moving sidewalk.

4. The passenger conveyor according to claim 1, wherein the passenger support includes one of a step, pallet, and conveyor belt.

5. A passenger conveyor comprising:

a passenger support configured to support one or more passengers;

a handrail linked to the passenger support such that the passenger support and the handrail move in registration with one another, the handrail movement guided by an underlying support; and a brake system for selectively preventing movement of the handrail and the passenger support in registration with the handrail, the brake system including a tensioner for selectively increasing a tension of the handrail, whereby friction between the handrail and the underlying support precludes the handrail and passenger support from moving;

wherein the tensioner for selectively increasing a tension of the handrail against the underlying support includes a tension bow adjacent the handrail and a forcing member associated with the tension bow for forcing the tension bow against the handrail.

6. The passenger conveyor according to claim 5, wherein the tension bow is one of a roller bow and a sliding bow.

7. The passenger conveyor according to claim 5, wherein the tension bow has associated therewith a guide angle in the handrail as it passes the tension bow, and wherein a force of application of the tension bow needed to produce a predetermined tension in the handrail is dependent on the guide angle of the tension bow.

8. The passenger conveyor according to claim 1, wherein the handrail riding against the underlying support includes first and second turnaround portions where the handrail turns substantially one hundred and eighty degrees, transition curve portions, as well as one or more linear portions wherein the handrail moves in a linear fashion, further including a drive system for driving the passenger support and the handrail including a drive pulley, and wherein the tensioner for selectively increasing a tension of the handrail is located in at least one location selected from the group consisting of a linear portion of the handrail, a turnaround portion of the handrail, a transition curve portion and adjacent the drive pulley.

9. The passenger conveyor according to claim 5, wherein the forcing member associated with the tension bow for forcing the tension bow against the handrail is actuated via one or more of hydraulic actuation, electro-magnetic actuation, electrical actuation, and spring actuation.

10. A method for braking a passenger conveyor having a passenger support configured to support one or more passengers and a handrail linked to the passenger support such that the passenger support and the handrail move in registration with one another, the handrail movement guided by an underlying support, the method comprising:

detecting a need to brake the passenger conveyor; and responsive to detecting a need to brake, selectively increasing a tension in the handrail to increase the friction between the handrail and underlying support until the handrail is precluded from moving, thus also stopping the passenger support.

11. The method for braking a passenger conveyor in accordance with claim 10, wherein the passenger conveyor is one of an escalator and a moving sidewalk.

12. The method for braking a passenger conveyor in accordance with claim 10, wherein the passenger support includes one of a conveyor belt, a linked plurality of steps, or a linked plurality of pallets.

13. A method for braking a passenger conveyor having a passenger support configured to support one or more passengers and a handrail linked to the passenger support such that the passenger support and the handrail move in registration with one another, the handrail movement guided by an underlying support, the method comprising:

detecting a need to brake the passenger conveyor; and responsive to detecting a need to brake, selectively increasing a tension in the handrail to increase the friction between the handrail and underlying support until the handrail is precluded from moving, thus also stopping the passenger support;

wherein the passenger conveyor includes a tension bow adjacent the handrail and a forcing member associated with the tension bow, and wherein selectively increasing a tension of the handrail against the underlying support comprises forcing the tension bow against the handrail via the forcing member.

14. The method for braking a passenger conveyor in accordance with claim 13, wherein the tension bow is one of a roller bow and a sliding bow.

15. The method for braking a passenger conveyor in accordance with claim 13, wherein the handrail riding against the underlying support includes first and second turnaround portions where the handrail turns substantially one hundred and eighty degrees, transition curve portions, as well as one or more linear portions wherein the handrail moves in a linear fashion, and wherein forcing the tension bow against the handrail via the forcing member includes forcing the tension bow against the handrail in at least one of a turnaround portion, a transition curve portion and a linear portion.

16. The method for braking a passenger conveyor in accordance with claim 13, wherein the passenger conveyor includes a driving pulley for driving the handrail and wherein forcing the tension bow against the handrail via the forcing member includes forcing the tension bow against the handrail adjacent the driving pulley.

17. The method for braking a passenger conveyor in accordance with claim 13, wherein forcing the tension bow against the handrail via the forcing member includes forcing the tension bow against the handrail by one of a hydraulic mechanism, electro-magnetic mechanism, electrical mechanism, and spring mechanism.

18. The method for braking a passenger conveyor in accordance with claim 13, wherein forcing the tension bow against the handrail via the forcing member provide at least one of operational braking and emergency safety braking.

19. A brake system for application to a passenger conveyor having a movable passenger support portion and a movable passenger handrail linked for concurrent movement to the passenger support portion, the brake system comprising a tension element configured to selectively increase tension in the handrail to provide a braking force for the passenger support portion resulting from increased tension of the handrail.

20. A brake system for application to a passenger conveyor having a movable passenger support portion and a movable passenger handrail linked for concurrent movement to the passenger support portion, the brake system comprising a tension element configured to selectively increase tension in the handrail to provide a braking force for the passenger support portion resulting from increased tension of the handrail;

wherein the tension element is one of a roller bow and a sliding bow.

21. The brake system according to claim 19, further including a forcing member associated with the tension element to force the tension element against the handrail.

22. The brake system according to claim 21, wherein the forcing member is actuated via one of hydraulic, electromagnetic, electrical, and spring force.

23. The brake system according to claim 21, wherein the forcing member is actuated to provide at least one of operational braking and auxiliary braking.

24. The brake system according to claim 21, wherein a tension in the handrail resulting from a force applied by the forcing member is dependent on a guide angle of the tension element.

25. The brake system according to claim 19, wherein the brake system may be deactivated automatically or manually in order to return the passenger conveyor to operating condition.

26. The brake system according to claim 19, further including a handrail drive system, wherein the handrail drive system is one of a pulley drive, a turnaround drive, and a linear drive.

* * * * *